US009174348B2

(12) United States Patent
Savolainen et al.

(10) Patent No.: US 9,174,348 B2
(45) Date of Patent: Nov. 3, 2015

(54) CUTTING TOOL

(75) Inventors: Heikki Savolainen, Helsinki (FI); Carl-Olof Holm, Helsinki (FI)

(73) Assignee: Fiskars Home Oy Ab, Helsinki (FI)

( * ) Notice: Subject to any disclaimer, the term of this patent is extended or adjusted under 35 U.S.C. 154(b) by 362 days.

(21) Appl. No.: 13/527,688

(22) Filed: Jun. 20, 2012

(65) Prior Publication Data

US 2013/0000131 A1 Jan. 3, 2013

(30) Foreign Application Priority Data

Jun. 30, 2011 (FI) ..... 20115689

(51) Int. Cl.
*B26B 13/28* (2006.01)
*B26B 13/26* (2006.01)

(52) U.S. Cl.
CPC ..... *B26B 13/26* (2013.01); *B26B 13/28* (2013.01)

(58) Field of Classification Search
CPC ..... B26B 13/04; B26B 13/28
USPC ..... 30/254, 259, 260, 266
See application file for complete search history.

(56) References Cited

U.S. PATENT DOCUMENTS

| | | | | | |
|---|---|---|---|---|---|
| 879,064 | A | * | 2/1908 | Prohaska | 30/260 |
| 2,369,271 | A | * | 2/1945 | Arnold | 30/260 |
| 2,370,308 | A | * | 2/1945 | Hanson | 81/329 |
| 2,445,480 | A | * | 7/1948 | Plannie | 81/382 |
| 2,532,359 | A | | 12/1950 | Drmic | |
| 2,607,114 | A | * | 8/1952 | Keiser, Jr. | 30/248 |
| 2,661,534 | A | | 12/1953 | Keiser, Jr. | |
| 2,758,372 | A | * | 8/1956 | Gammons | 30/260 |
| 3,834,022 | A | * | 9/1974 | Students | 30/261 |
| 3,971,131 | A | * | 7/1976 | Boyajian et al. | 30/260 |
| 4,014,093 | A | * | 3/1977 | Keiser, Jr. | 30/248 |
| 4,715,122 | A | * | 12/1987 | Linden | 30/254 |
| 5,020,222 | A | * | 6/1991 | Gosselin et al. | 30/251 |
| 5,086,563 | A | * | 2/1992 | Sakuma et al. | 30/260 |
| 5,689,888 | A | * | 11/1997 | Linden | 30/250 |
| 5,697,159 | A | | 12/1997 | Linden | |
| 6,481,106 | B1 | | 11/2002 | Paloheimo et al. | |
| 6,938,347 | B2 | | 9/2005 | Linden et al. | |
| 6,941,663 | B2 | | 9/2005 | Still | |

(Continued)

FOREIGN PATENT DOCUMENTS

| | | |
|---|---|---|
| DE | 8716229 U1 | 1/1988 |
| DE | 198 16 693 A1 | 10/1999 |

(Continued)

OTHER PUBLICATIONS

Office Action Issued in EPO Application No. 12173543.5 Filed Oct. 16, 2012.

(Continued)

*Primary Examiner* — Hwei C Payer
(74) *Attorney, Agent, or Firm* — Foley & Lardner LLP

(57) ABSTRACT

The invention relates to a cutting tool (1) comprising: a first handle (2) and a first blade (3) fixedly attached to each other, a second handle (4) and a second blade (5) pivotably attached to each other by a first pivot (6) and a second pivot (7). In order to obtain a cutting tool with an optimal cutting force, the cutting tool comprises a limiter (11) allowing the back end (9') to move sideways (S) in relation to the second handle (4) and preventing the back end (9) at least from moving away from the second handle (4) in an axial direction (A) of the first pivot (6).

8 Claims, 2 Drawing Sheets

(56) References Cited

U.S. PATENT DOCUMENTS

| | | | | |
|---|---|---|---|---|
| 7,204,022 | B2 * | 4/2007 | Tsuda | 30/194 |
| 7,441,337 | B2 | 10/2008 | Linden et al. | |
| 8,046,924 | B2 | 11/2011 | Block et al. | |
| 8,136,252 | B2 | 3/2012 | Linden et al. | |
| 8,220,164 | B2 | 7/2012 | Linden et al. | |
| 8,458,912 | B2 | 6/2013 | Linden et al. | |
| 2003/0110642 | A1 | 6/2003 | Still | |
| 2010/0319202 | A1 * | 12/2010 | Lin | 30/226 |

FOREIGN PATENT DOCUMENTS

| | | | |
|---|---|---|---|
| DE | 10 2005 006 085 | A1 | 8/2006 |
| EP | 0 662 374 | A1 * | 7/1995 |
| EP | 0 765 717 | A1 * | 4/1997 |
| TW | 201119813 | A1 | 6/2011 |
| WO | 96/31326 | A1 | 10/1996 |

OTHER PUBLICATIONS

International Search Report issued by the Taiwanese Patent Office dated May 8, 2014 for corresponding Taiwanese Application No. 101123157.

Espacenet English abstract of TW 201119813 A1, dated Nov. 2013.

First Office Action in Chinese Patent Application No. 201110393378.9, dated Mar. 19, 2015 with English translation, 14 pages.

* cited by examiner

CUTTING TOOL

BACKGROUND OF THE INVENTION

1. Field of the Invention

This invention relates to a cutting tool and in particular to a cutting tool having an improved cutting performance.

2. Description of Prior Art

Previously there is known a cutting tool with a first handle fixedly attached to a first blade, and with a second handle and a second blade pivotably attached to each other at a pivot attaching also the first handle and the first blade to the second handle and the second blade.

In this known cutting tool, a second pivot is arranged at a distance from the first pivot to attach the second handle and the second blade pivotably to each other. In this way the second pivot makes it possible to transmit the force generated by a user on the handles to the blades as an optimal and maximal cutting force.

A problem with the prior art solution is, however, that as the cutting force increases the forces applied by the user on the handles tend to bend the material of the cutting tool as the handles, the blades and/or the pivot points yield. Such yielding can affect the distance between the blades resulting in a situation where the cutting tool no longer cuts the desired material efficiently.

SUMMARY OF THE INVENTION

An object of the present invention is to solve the above-mentioned drawback and to provide a novel cutting tool capable of efficient cutting with a maximal cutting force.

The use of a limiter in an overlapping region of a back end of the second blade and the second handle makes it possible to prevent at least that the back end moves away from the second handle in an axial direction of the first pivot. Therefore, possible yielding of the material in the cutting tool does not have any negative impact on the distance between the blades during cutting. The user may, therefore, excess a significant force on the handles of the cutting tool, which leads to an optimal cutting force and efficient cutting of the material being cut with the cutting tool.

In this context the term "overlapping" region refers to a region where a surface of the second handle and the back end extend in a side-by-side relation allowing movement of the back end sideways in relation to the second handle during the use of the cutting tool.

Preferred embodiments of the invention are disclosed in the dependent claims.

BRIEF DESCRIPTION OF DRAWINGS

In the following the present invention will be described in more detail by way of example and with reference to the attached drawings, in which.

DESCRIPTION OF AT LEAST ONE EMBODIMENT

Figure 1:
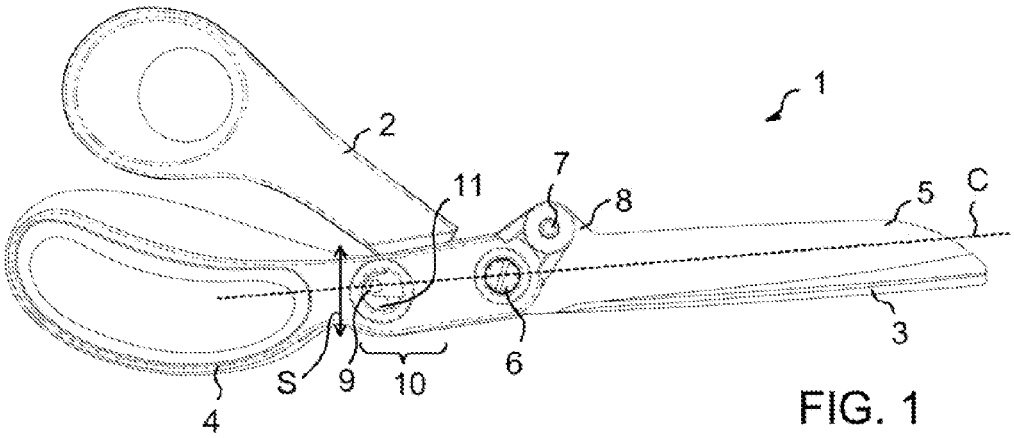
FIGS. 1 to 4 illustrate a first embodiment of a cutting tool.
Figure 2:
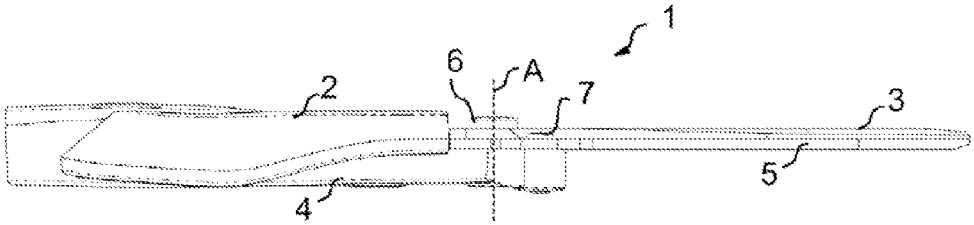
Figure 3:
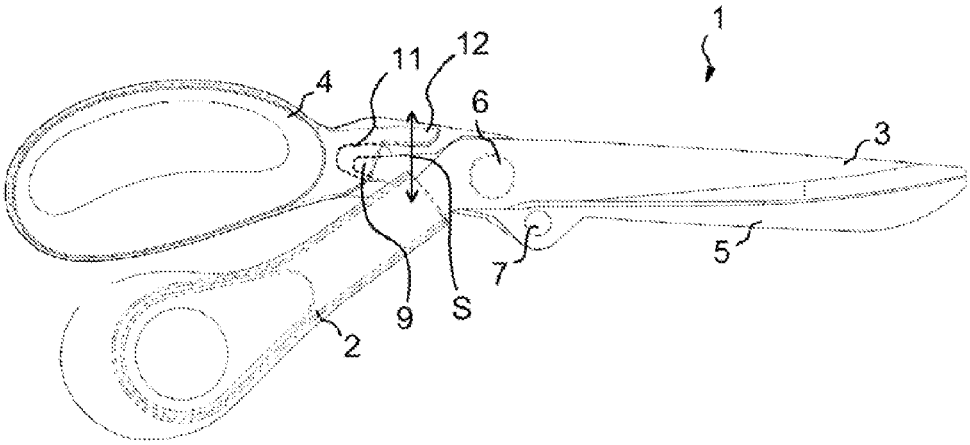
Figure 4:
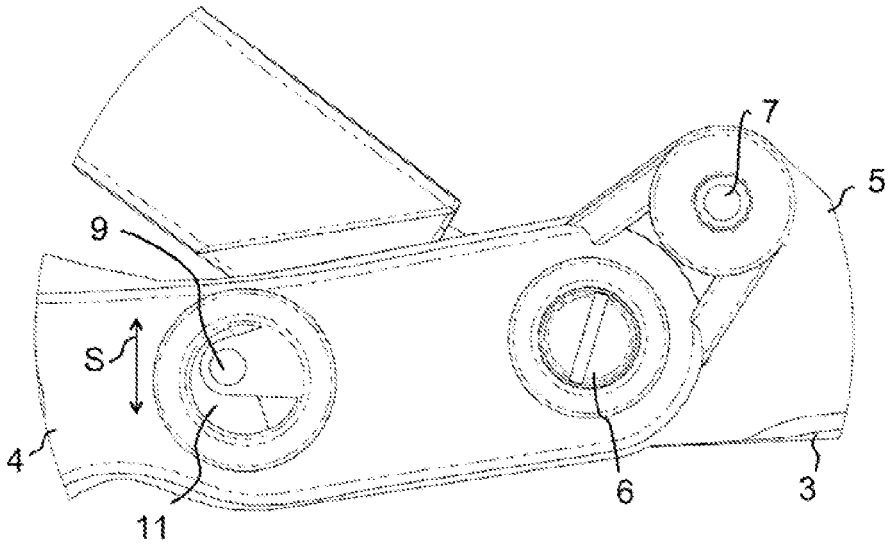

FIGS. 1 to 4 illustrate a first embodiment of a cutting tool 1 which in this example consists of a pair of scissors. FIG. 1 is a view from one side, FIG. 2 from above, FIG. 3 from a second side, and FIG. 4 is an enlargement of the region where the different parts of the cutting tool are attached to each other.

The cutting tool 1 comprises a first handle 2 which is fixedly attached to a first blade 3. The first handle 2 can be of plastic and the first blade 3 of steel, for instance. A cutting edge is arranged to the first blade in a conventional matter. The first handle 2 comprises a distal end (in relation to the first blade) with a loop for receiving a thumb of a user while the cutting tool is used.

The cutting tool 1 also comprises a second handle 4 and a second blade 5. The second handle 4 can be of plastic and the second blade 5 of steel, for instance. A cutting edge is arranged to the second blade in a conventional matter. The second handle 4 comprises in a distal end (in relation to the second blade) a loop for receiving one or more fingers (other than the thumb) of a user while the cutting tool is used.

The second handle 4 and the second blade 5 are not fixedly attached to each other. Instead, they are attached to each other and also pivotably attached to the first handle 2 and to the first blade 3 by a first pivot 6, which may be implemented by a screw or rivet extending through the cutting tool in an axial direction A. The second handle 4 and the second blade 5 are additionally attached to each other by a second pivot 7, which may also be implemented by a screw or rivet extending through the second handle and the second blade. Such a construction with two pivots 6 and 7 makes it possible to increase the cutting force. In this connection the term "pivotably attached" should be understood as an attachment between two parts that allows the parts to rotate in relation to each other, and that prevents all other movement between the parts in relation to each other.

The second pivot 7 is arranged at a location where the elongated second blade 5 is provided with a wider section 8. As illustrated in the figures, the second pivot 7 point is located at a distance from the first pivot point 6 and further away from a back end 9 of the second blade 5 than the first pivot point 6. Preferably the wider section 8 protrudes from a center line C of the second blade 5 towards the side of the first handle 2 intended to be used by the thumb of the user. In this way the wider section 8 is in practice located in an upper part of the cutting tool during use, where it does not block the material being cut from passing smoothly below the cutting tool 1.

The back end 9 of the second blade 5 overlaps the second handle 4 in an overlapping region 10. In this region the second handle 4 and the back end 9 extend in a side-by-side relation allowing a sideway S movement of the back end 9 in relation to the second handle 4 during the use of the cutting tool 1, provided that a sufficient force leading to yielding is applied by the user. In order to avoid that such yielding leads to a situation where the distance between blades 3 and 5 changes in the axial direction of the first pivot 6, a limiter 11 is arranged to the cutting tool.

In the embodiment of FIGS. 1 to 4, the limiter 11 consists of a recess or pocket provided in the second handle 4, into which the back end 9 penetrates. The height of the recess in the axial direction A of the first pivot 6 substantially corresponds to the thickness of the back end 9 in the axial direction A of the first pivot 6. In the overlapping region 10, any movement in the axial direction A of the first pivot 6 between the back end 9 and the second handle 4 can, thus, be prevented. Additionally, the width of the recess or pocket is larger than the width of the back end 9 such that the limiter allows the back end 9 to move sideways S in relation to the second handle 4. The possibility to move sideways ensures that the forced directed to the handles 2 and 4 by the user is transmitted to the blades via the first and second pivots 6, 7 and not via the back end 9 of the second blade and the handle 4 (which would lead to a reduced cutting force).

It is possible that the limiter 11 prevents the back end 9 both from moving towards the second handle 4 and away from the second handle 4 in the axial direction A of the first pivot. This is, however, not necessary in all embodiments. Instead as illustrated in the embodiment of FIGS. 1 to 3, it is sufficient that the limiter 11 prevents the back end 9 at least from moving away from the second handle 4 in the axial direction A of the first pivot. As can be seen in FIGS. 1 to 3, a hole has been arranged into second handle 4 at the location of the back end and consequently this hole gives room for the back end 9 to move towards the second handle in the axial direction of the first pivot 6.

In addition to the limiter 11, the cutting tool 1 of FIGS. 1 to 4 is also provided with a side preventer 12 limiting sideway S movements of the back end 9 in relation to the second handle 4 to a predetermined distance. In this example the side preventer 12 consists of a protrusion provided in the second handle which comes into contact with the back end 9 of the second blade 5 once the cutting force has increased to such an extent that significant yielding occurs in the handle 4, blade 3 and/or pivots 6 and 7. During such significant yielding the side preventer 12 ensures that the yielding cannot continue unlimited. Therefore, the side preventer 12 is arranged at a predetermined distance from the normal location of the back end 9, in which case normal refers to a location where the back end 9 is (in relation to the second handle 4) while the cutting tool is not used.

Figure 5:
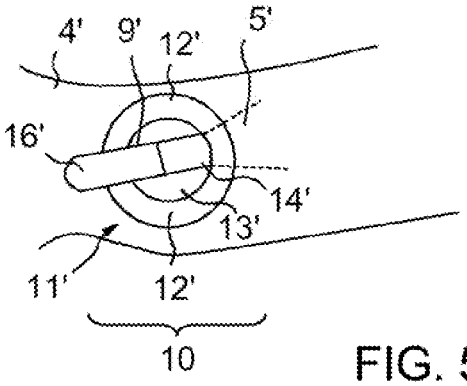
FIGS. 5 and 6 illustrate a second embodiment of a cutting tool.
Figure 6:
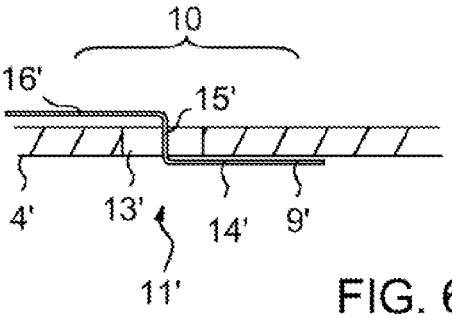

FIGS. 5 and 6 illustrate a second embodiment of a cutting tool. The embodiment of FIGS.5 and 6 is very similar to the one explained in connection with FIGS.1 to 4. therefore, the embodiment of FIGS 5 and 6 will mainly be explained by pointing out the differences between these embodiments.

FIGS. 5 and 6 only illustrate a part of the second handle 4' and the back end 9' of the second blade 5' in the overlapping region 10. In this embodiment the limiter 11' consists of a hole 13' through the second handle 4' and a curved section on the back end 9' of the second blade, the curved section comprising a first section 14' extending substantially parallel with a first surface of the second handle 4' continuing from the first section 14' and protruding through the hole 13', and a third section 16' continuing from the second section and extending substantially parallel with a second surface of the second handle 4'. Contact between the first section 14' and the second handle 4', and the second section 16' and the second handle 4', respectively, prevent the back end 9' from moving in an axial direction of the first pivot in relation to the second handle 4'.

In the embodiment of FIGS. 5 and 6, the sides of the hole 13' function as a side preventer 12' limiting sideway movements of the back end 9' in relation to the second handle 4' to a predetermined distance.

Figure 7:
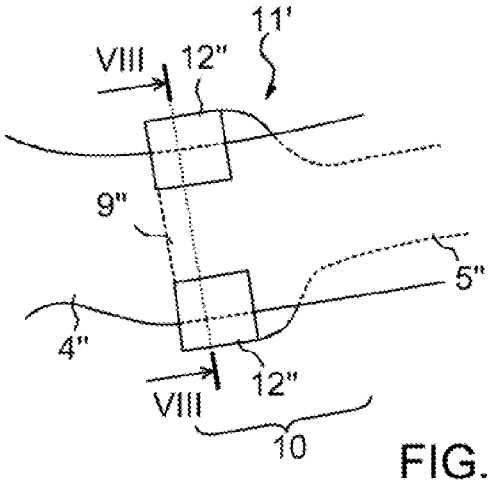
FIGS. 7 and 8 illustrate a third embodiment of a cutting tool.
Figure 8:
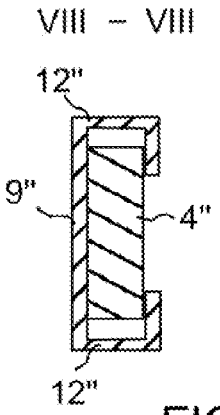

FIGS. 7 and 8 illustrate a third embodiment of a cutting tool. The embodiment of FIGS. 7 and 8 is very similar to the one explained in connection with FIGS. 1 to 4. Therefore the embodiment of FIGS. 7 and 8 will be mainly explained by pointing out the differences between these embodiments.

FIGS. 7 and 8 only illustrate a part of the second handle 4" and the back end 9" of the second blade 5" in the overlapping region 10. In this embodiment the limiter 11" consists of a section of the back end with a width larger than the width of the second handle 4" (in this part of the handle) and with opposite side protrusions 12" initially extending in an axial direction A of the first pivot 6 and continuing as sections overlapping the second handle 4", whereby the section of the back end 9" and the protrusions 12" surround the second handle 5" on four sides of the second handle 5". In this connection "surround" does not require that the second handle is completely surrounded, as there may be a gap between the side protrusions 12", for instance, as illustrated in FIGS. 7 and 8.

The protrusions 12" also function as a side preventer 12" limiting sideway movements of the back end 9" in relation to the second handle 4" to a predetermined distance.

It is to be understood that the above description and the accompanying figures are only intended to illustrate the present invention. It will be obvious to a person skilled in the art that the invention can be varied and modified without departing from the scope of the invention.

The invention claimed is:

1. A cutting tool comprising:

a first handle, a first blade with a cutting edge, the first blade being fixedly attached to the first handle, a second handle, a second blade with a cutting edge, the second blade has a back end overlapping the second handle in an overlapping region, a first pivot extending through the first blade, the second handle and the second blade and attaching the first blade and the first handle pivotably to the second handle and the second blade, the first pivot also attaches the second handle and the second blade to each other, a second pivot attaching the second handle and the second blade to each other, the second pivot is located at a distance from the first pivot, and a limiter in the overlapping region, the limiter allowing the back end to move sideways in relation to the second handle and preventing the back end at least from moving away from the second handle in an axial direction of the first pivot.

2. The cutting tool according to claim 1, wherein the limiter comprises a side preventer limiting sideway movements of the back end in relation to the second handle to a predetermined distance.

3. The cutting tool according to claim 1, wherein the cutting tool further consists of a recess provided in the second handle into which the back end penetrates, the height of the recess in the axial direction of the first pivot substantially corresponding to the thickness of the back end in the axial direction of the first pivot, and the width of the recess is larger than the width of the back end for allowing the back end to move sideways in relation to the second handle.

4. The cutting tool according to claims 1, wherein the second pivot is located further away from the back end of the second blade than the first pivot.

5. The cutting tool according to claim 1, wherein the second blade is elongated and provided with a wider section in a middle part of the second blade, and in that the second pivot is located in the wider section.

6. The cutting tool according to claim 1, wherein said cutting tool is a pair of scissors.

7. The cutting tool according to claim 1, wherein the limiter includes a hole through the second handle and a curved section on the back end of the second blade, the curved section comprising a first section extending substantially parallel with a first surface of the second handle, a second section continuing from the first section and protruding through the hole, and a third section continuing from the second section and extending substantially parallel with a second surface of the second handle.

8. The cutting tool according to claim 1, wherein the limiter includes a section of the back end of the second blade with a width larger than the width of the second handle in this part of the second handle and with opposite side protrusions initially extending in an axial direction of the first pivot and continuing as sections overlapping the second handle, whereby the section of the back end and the protrusions surround the second handle on four sides of the second handle.

* * * * *